US010072668B2

(12) United States Patent
Maloyan et al.

(10) Patent No.: US 10,072,668 B2
(45) Date of Patent: Sep. 11, 2018

(54) SYSTEMS AND METHODS FOR GENERATING CLEAN ENERGY THROUGH HYDRODYNAMIC CLOSED CYCLE

(71) Applicants: Zhora Hovsep Maloyan, Los Angeles, CA (US); Arman Zhora Maloyan, Los Angeles, CA (US)

(72) Inventors: Zhora Hovsep Maloyan, Los Angeles, CA (US); Arman Zhora Maloyan, Los Angeles, CA (US)

(73) Assignees: Zhora Hovsep Maloyan, Los Angeles, CA (US); Arman Zhora Maloyan, Los Angeles, CA (US)

( * ) Notice: Subject to any disclaimer, the term of this patent is extended or adjusted under 35 U.S.C. 154(b) by 0 days.

(21) Appl. No.: 15/668,398

(22) Filed: Aug. 3, 2017

(65) Prior Publication Data

US 2018/0045212 A1 Feb. 15, 2018

Related U.S. Application Data

(60) Provisional application No. 62/494,482, filed on Aug. 11, 2016.

(51) Int. Cl.
*F04D 29/22* (2006.01)
*F04D 13/06* (2006.01)
(Continued)

(52) U.S. Cl.
CPC ..... *F04D 29/22* (2013.01); *F04D 13/021* (2013.01); *F04D 13/06* (2013.01); *F04D 29/043* (2013.01); *F04D 29/426* (2013.01); *F04D 1/00* (2013.01)

(58) Field of Classification Search
CPC ..... F04D 29/22; F04D 13/021; F04D 29/426; F04D 13/06; F04D 29/043; F04D 1/00;
(Continued)

(56) References Cited

U.S. PATENT DOCUMENTS 596,619 A * 1/1898 Renner ..... F04F 1/06 417/137
1,581,204 A * 4/1926 Hariveau ..... F04D 9/005 415/24

(Continued)

FOREIGN PATENT DOCUMENTS

AM 548 A2 3/1999
AM 761 A2 3/2000

(Continued)

OTHER PUBLICATIONS

STIC Search Report, USPTO, Generated Nov. 24, 2017.*

*Primary Examiner* — Eldon Brockman
(74) *Attorney, Agent, or Firm* — Morrison and Foerster LLP

(57) ABSTRACT

Systems for pumping water are described. The system can include a covered pool containing a first volume of water, an oared water pump with a plurality of radial oars, an upper reservoir configured in fluid communication with the covered pool, a lower reservoir and a hydroelectric system. The oared pump can pump water from the covered pool into the upper reservoir. The upper reservoir can be configured to communicate water to the lower reservoir through the hydroelectric system with the lower reservoir configured in fluid communication with the covered pool.

19 Claims, 5 Drawing Sheets

(51) Int. Cl.

| | |
|---|---|
| ***F04D 29/043*** | (2006.01) |
| ***F04D 29/42*** | (2006.01) |
| ***F04D 13/02*** | (2006.01) |
| *F04D 1/00* | (2006.01) |

(58) Field of Classification Search
CPC ..... F04D 15/0044; F04F 1/06; Y02E 10/22; Y02E 10/223; Y02E 10/226; F03B 3/04; F03B 13/06; F03B 13/08; F03B 7/00
See application file for complete search history.

(56) References Cited

U.S. PATENT DOCUMENTS

| | | | | | |
|---|---|---|---|---|---|
| 2,427,307 | A * | 9/1947 | Schleyer | F04D 1/006 | 222/64 |
| 3,747,904 | A * | 7/1973 | Gross | A01K 63/042 | 119/226 |
| 4,023,915 | A * | 5/1977 | Kerby | F03B 17/063 | 415/148 |
| 4,180,976 | A * | 1/1980 | Bunn | F03B 13/086 | 137/123 |
| 4,280,789 | A * | 7/1981 | Graden | F03B 13/00 | 415/6 |
| 4,396,842 | A | 8/1983 | Jhun | | |
| 4,629,904 | A | 12/1986 | Rojo, Jr. et al. | | |
| 5,947,678 | A | 9/1999 | Bergstein | | |
| 6,234,761 | B1 | 5/2001 | Kocsis et al. | | |
| 6,267,551 | B1 | 7/2001 | Dentinger | | |
| 8,371,826 | B1 | 2/2013 | Johnson et al. | | |
| 8,686,584 | B2 * | 4/2014 | Godinich | A01K 61/00 | 290/54 |
| 8,698,333 | B2 | 4/2014 | Glasser et al. | | |
| 9,303,512 | B2 | 4/2016 | Iijima | | |
| 2010/0072754 | A1 * | 3/2010 | Huang | F03B 17/005 | 290/54 |
| 2010/0283162 | A1 * | 11/2010 | Galletta, Jr. | B01F 3/04765 | 261/91 |
| 2011/0293416 | A1 | 12/2011 | Rohden | | |
| 2012/0012564 | A1 | 1/2012 | Mao et al. | | |
| 2012/0125624 | A1 | 3/2012 | Dyer | | |
| 2015/0322969 | A1 | 11/2015 | Tanaka et al. | | |
| 2015/0354526 | A1 | 12/2015 | Cripps | | |
| 2016/0084249 | A1 | 3/2016 | Muramatsu et al. | | |
| 2016/0090984 | A1 | 3/2016 | Cass et al. | | |

FOREIGN PATENT DOCUMENTS

| | | | |
|---|---|---|---|
| AM | 1884 | A2 | 12/2006 |
| AR | M-1732 | A2 | 3/2006 |
| RU | 877125 | | 10/1981 |
| RU | 2131993 | C1 | 6/1999 |
| RU | 2215196 | C2 | 10/2003 |
| RU | 2376494 | C2 | 12/2009 |
| RU | 2488713 | C2 | 7/2013 |

* cited by examiner

SYSTEMS AND METHODS FOR GENERATING CLEAN ENERGY THROUGH HYDRODYNAMIC CLOSED CYCLE

CROSS-REFERENCE TO RELATED APPLICATIONS

This application claims benefit of U.S. Provisional Patent Application No. 62/494,482, filed Aug. 11, 2016, which is hereby incorporated by reference in its entirety.

FIELD OF THE DISCLOSURE

This relates generally to systems and methods for generating hydroelectric power.

BACKGROUND OF THE DISCLOSURE

The production of electric power enables countless aspects of modern society and global demand for electric power seems to increase every year. Consequently, any device that can generate electric power is potentially valuable as a means of meeting the growing global demand for electric power. Furthermore, devices for generating power without emitting substantial amounts of greenhouse gasses are especially valuable in light of the threat of climate change as a possible consequence of greenhouse gasses emitted by many current forms of producing electric power.

SUMMARY OF THE DISCLOSURE

Some embodiments described in this disclosure are directed to a hydroelectric station to generate electric power. Some embodiments described in this disclosure are directed to hydroelectric stations with at least one oared pump with a plurality of radial oars. In some embodiments, any two adjacent radial oars of the plurality of radial oars can substantially form an angle. Moreover, in some embodiments the plurality of radial oars can include fifteen oars; in other embodiments the plurality of radial oars can include twenty radial oars. Some embodiments can include a covered pool that contains a first volume of water, and the oared pump can pump a portion of the first volume of water out of the covered pool and into a reservoir. The reservoir can be configured in fluid communication with the covered pool. In some embodiments, the reservoir can be configured to allow a second volume of water to flow into the covered pool via a hydro turbine system. In some embodiments, the second volume of water flowing from the reservoir and to the hydro turbine system can cause the hydro turbine system to communicate electric power to the oared pump. The full descriptions of the embodiments are provided in the Drawings and the Detailed Description, and it is understood that the Summary provided above does not limit the scope of the disclosure in any way.

BRIEF DESCRIPTION OF THE DRAWINGS

For a better understanding of the various described embodiments, reference should be made to the Detailed Description below, in conjunction with the following drawings in which like reference numerals refer to corresponding parts throughout the figures.

DETAILED DESCRIPTION

Description of Embodiments

The following description sets forth exemplary methods, parameters, and the like. It should be recognized, however, that such description is not intended as a limitation on the scope of the present disclosure but is instead provided as a description of exemplary embodiments.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
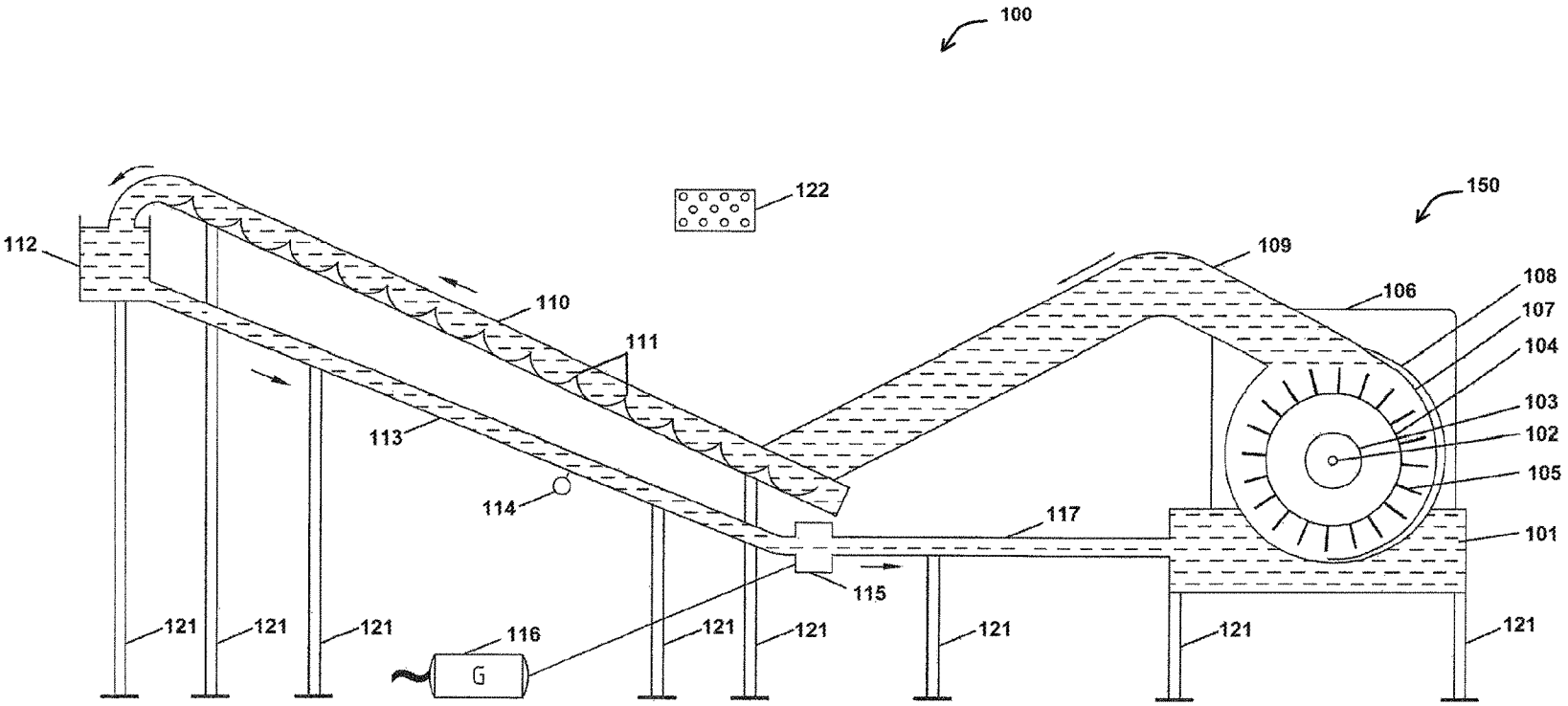
FIG. 1 illustrates a hydroelectric station in accordance with some embodiments.

FIG. 1 illustrates a hydroelectric station 100 in accordance with one embodiment. In some embodiments, the hydroelectric station 100 includes a covered pool 101 and an oared pump 150, which can further include a plurality of radial oars coupled to a cylindrical body 104, and a rotary 103 that is coupled to the cylindrical body 104 and to a shaft 102, to form a radial oar pump 150. Further, in some embodiments several of the components of the oared pump 150 (e.g., the plurality of radial oars 105, the cylindrical body 104, rotary 103 and shaft 102) are disposed at least partially within a roll-shaped cover 108. Furthermore, in some embodiments the roll-shaped cover 108 can be disposed within the pump cover 106. In some embodiments, the radial oars 105 can extend radially outward from the center of the cylindrical body 104, for example as shown in the embodiment of FIG. 1. In some embodiments, the oared pump 350 can be configured such that the cylindrical body 104 rotates at three thousand rotations per minute when the oared pump 150 operates. Alternatively, in other embodiments the oared pump 150 can be configured such that the cylindrical body rotates at two thousand rotations per minute when the oared pump 150 operates. As yet another example, in another embodiment the oared pump 150 may be configured such that the cylindrical body 104 rotates at one thousand rotations per minute when the oared pump 150 operates. As can be appreciated, in other embodiments of the system 100 the oared pump 150 can be configured such that the cylindrical body 104 rotates at any suitable number of rotations per minute when the oared pump 150 operates.

In many embodiments, the shaft 102 is coupled to one or more reducing gears that are in turn coupled to one or more electro motors, such that when the electro motor revolves at a specified number of revolutions per minute the reducer gear causes the shaft 102, and thereby the rotary 103 and the cylindrical body 104. The term reducer gear can refer to any suitable mechanism for converting the revolutions per minute of the shaft 102 to an appropriate number of revolutions per minute of the cylindrical body 104. As specific examples, a gearbox or transmission may be used to convert the revolutions per minute of the shaft 102 to another number of revolutions per minute of the cylindrical body 104. Thus, the reducer gear can be used to cause the cylindrical body 104 to revolve at a specified number of revolutions per minute that is some fraction (or multiple) of the revolutions per minute at which an electromotor revolves, the ratio of which is determined according to a reduction (or multiple) ratio (or a gear ratio) of the reducer gear.

For example, in one embodiment the reducer gear may have a reduction ratio of two to one and the electromotor may operate at ten rotations per minute and the reducer gear may cause the cylindrical body 104 to rotate at five rotations per minute. As another example, in another embodiment the reducer gear may have a reduction ratio of ten to one and the electromotor may operate at ten rotations per minute and the reducer gear may cause the cylindrical body to rotate at only one rotation per minute. As still another example, in one embodiment the reducer gear may have a reduction ratio of one hundred to one and the electromotor may operate at one thousand rotations per minute and the reducer gear may cause the cylindrical body 104 to rotate at ten rotations per minute. As yet another example, the reducer gear can be configured with a reduction ratio of ten and the at least one electromotor can input 30,000 rotations per minute into the reducer gear and the reducer gear may cause the cylindrical body 104 to rotate at 3,000 rotations per minute. As can be appreciated, however, the electromotor and reducer gear can be configured with any suitable rotations per minute (e.g., at the at least one electromotor and the cylindrical body 104) as required by the system 100.

In some embodiments the oared pump 150 can be configured such that when the system operates the shaft 102 is not substantially submerged in the water contained by the covered pool 101. In some embodiments, the oared pump 150 can include a plurality of radial oars 105 configured with a specific number of radial oars 105. For example, in some embodiments the plurality of radial oars 105 includes at least 10 radial oars coupled to the cylindrical body 104 of the oared pump 150. In other embodiments, the plurality of radial oars 105 includes at least 15 radial oars coupled to the cylindrical body 104 of the oared pump 150. In yet other embodiments, the plurality of radial oars 105 includes at least 18 radial oars coupled to the cylindrical body 104 of the oared pump 150. As can be appreciated, other embodiments of the oared pump 150 can include a plurality of radial oars 105 configured with any suitable number of radial oars.

In some embodiments of the system 100, each of the radial oars of the plurality 105 can also be disposed at a specific angle relative to each adjacent oar. For example, in some embodiments, each oar of the plurality of radial oars 105 can be separated from each other oar of the plurality of radial oars by a radial angle of twenty degrees. In other embodiments, each oar of the plurality of radial oars 105 can be separated from each other oar of the plurality of radial oars 105 by a radial angle of thirty degrees. As can be appreciated, the radial angle between any two adjacent radial oars of the plurality of radial oars 105 can be determined by the number of radial oars in the plurality 105 and can be configured to substantially form any angle suitable for the operation of the oared pump 150.

For example, the angle substantially formed by two adjacent radial oars of the plurality of radial oars 105 can be determined by the number of oars in the plurality of radial oars 105, the thickness of each radial oar of the plurality of radial oars 105, the size of the cylindrical body 104 of the oared pump 150, and the like. More specifically, the angle between any two adjacent radial oars of the plurality of radial oars 105 is not limited to angles between twenty and thirty degrees, and instead any two adjacent oars of the plurality of radial oars 105 can substantially form any angle that is suitable for the operation of the oared pump 150.

In some embodiments, the cylindrical body 104 and the plurality of radial oars 105 are configured such that the distance from the tip of the uppermost radial oar (as shown in FIG. 1) to the tip of the lowest radial oar is approximately 1 meter. In other embodiments, the distance from the tip of the uppermost radial oar to the tip of the lowest radial oar can be approximately half a meter. As can be appreciated, in other embodiments the distance from the tip of the uppermost radial oar to the tip of the lowest radial oar can be any suitable distance based on the configuration of the system 100 as a whole.

In some embodiments, a router 107 can be fixedly coupled to the pump cover 106. In some embodiments, the router 107 can be configured with a substantially round, semi-round, or substantially curved shape. More specifically, the router 107 can be configured (e.g., shaped) so that when the plurality of radial oars 105 are spinning (e.g., during operation of the oared pump 150) the plurality of radial oars 105 approach the router 107 without actually coming into physical contact with it. More specifically, when the oared pump 150 operates, each oar of the plurality of radial oars 105 spins and the edge of an oar that is opposite the cylindrical body 104 can approach the router 107, but the router may be configured with the appropriate curved or semi-round shape for the size of the cylindrical body and the length of each oar of the plurality of radial oars 105 so that none of the oars actually touches the router 107. In some embodiments, the router 107 is fixedly coupled with at least one side panel 108 which may reduce water loss or further facilitate the flow of water into the sloped crank pipe 109. In some embodiments, the upper end of the router 107 is fixedly coupled with sloped crank pipe 109, which, in certain embodiments, may have a square cross section. In some embodiments, the router 107 can be configured to direct water into the sloped crank pipe 109 when the oared pump 150 operates (i.e., when the cylindrical body 104 revolves in a counterclockwise direction).

In some embodiments, the sloped crank pipe 109 is in fluid communication with the sloped canal 110. Moreover, in some embodiments the sloped canal 110 can be configured with a waveform floor 111, for example as in the embodiment illustrated by FIG. 1. In some embodiments, sloped canal 110 can be sloped at an angle of 30-45 degrees from the horizontal. Waveform floor 111 can facilitate the pumping of water, by oared pump 150, up to reservoir 112, which can be at a relatively high altitude compared with oared pump 150 and covered pool 101. In some embodiments, the waveform floor 111 can be configured to allow the oared pump 150 to pump water up the sloped canal 110 with discrete increments of pressure at each portion of the sloped canal 110 and waveform floor 111. More specifically, in some embodiments the oared pump 150 can cause the water at a first portion of the waveform floor 111 to flow to the next portion of the waveform floor 111 when a discrete or specific pressure exists at that portion of the waveform floor 111. Furthermore, in some embodiments the pressure required to pump water from one portion of the waveform floor 111 to the next portion of the waveform floor 111 may be determined by the slope of the sloped canal 110 and the size, proportion, and material of the waveform floor 111. In some embodiments, the waveform floor 111 (or one or more surfaces thereof) may be composed of a plastic material (or a suitable polymer) configured to cause minimal friction with water flowing over the waveform floor 111. For example, in some embodiments the waveform floor 111 may be formed from thermoplastic shaped to form the waveform floor.

In some embodiments, the upper end of the sloped canal 110 may be in fluid communication with the reservoir 112, and through reservoir 112, the sloped canal 110 may also be in fluid communication with a turbine pipe 113, which can feed water down in altitude from reservoir 112 to hydro turbine system 115.

In some embodiments, the system 100 includes a hydro generator system 116 mechanically coupled to the hydro turbine system 115. In certain embodiments, water may circulate through the hydro turbine system 115 (e.g., water flowing down from reservoir through downpipe 113) and then into a water release pipe 117, which is in fluid communication with the covered pool 101. That is, in some embodiments gravity may cause the water to flow through the hydro turbine system 115, into the water release pipe 117 and finally flow into the covered pool 101. In some embodiments, therefore, the same water pumped out of the covered pool 101 by the oared pump 150 can flow into the covered pool 101 after flowing through the hydro turbine system 115 and the water release pipe 117. In some embodiments, the bottom of covered pool 101 can be sloped toward oared pump 150 (e.g., at 10, 15 or 30 degrees down, from left to right) to feed water from covered pool 101 to oared pump 150.

In some embodiments, the turbine pipe 113 is in fluid communication with the water release pipe 117 through the reservoir 112 and the hydro turbine system 115. In certain embodiments, the turbine pipe 113 can be removed from fluid communication with the hydro turbine system 115 via operation of a lock 114. In some embodiments, closing the lock 114 can close the sloped canal 110. For example, during operation of the system 100, the lock 114 can be closed and may prevent water from flowing out of the turbine pipe 113. In some embodiments, closing the lock 114 can also prevent water from flowing from the reservoir 112 and in turn removes the water upraise canal 110 from fluid communication with the rest of the system 100. As another example, in some embodiments the lock 114 can be configured to safely terminate the operation of the system 100 or to substantially terminate the flow of water within the system 100 when the lock 114 is engaged.

In some embodiments, the lock 114 is placed between the reservoir 112 and the generator system 115, such as in the embodiment illustrated in FIG. 1. As can be appreciated, however, in other embodiments the lock 114 can be placed in any suitable point within the system 100. In some embodiments, the lock 114 may be configured with electronic controls (e.g., at least one electronically controlled actuator) so that an automated management system (e.g., automated management system 122) can be configured to open and close the lock 114 to automatically control operation of the system 100. Thus, when the system is meant to idle or cease operation (e.g., to perform maintenance on the system 100) the lock 114 can be engaged (e.g., via electrical signal generated by automated management system 122) to cease operation of the system and substantially stop the water flow within the system 100.

In some embodiments, each of the components of the system 100 can be supported by a plurality of supports or base columns 121. As can be appreciated, the plurality of supports 121 can be configured to rigidly couple to each of the components of 100 in a manner than stabilizes and supports the system, such as during its operation. Moreover, in some embodiments one or more of the base columns of the plurality of supports 121 can be configured to physically couple with, or support, a body or housing that in turn couples with, or supports, the system 100.

In some embodiments, the system 100 includes an automated management system 122 that can control the operation of the hydroelectric station 100, including the operation of the oared pump 150, operation of the lock 114, the operation of the hydro turbine system 115, and the operation of the hydro generator system 116. In some embodiments, the automated management system 122 can be configured to control each aspect of the operation of system 100, including the mechanical and electrical aspects of its operation such as closing or opening the lock 114 to allow the flow of water to the hydro turbine system 115 or to substantially stop the flow of water to the hydro turbine system 115 such as for performing maintenance on the system 100.

The automated management system 122 can include a processor that may execute instructions stored on a computer readable storage media that is configured in electrical communication with the processor. Moreover, in some embodiments the processor may include memory to help it execute the instructions stored on the computer readable storage media. For example, the automated management system 122 can be configured with a processor that executes a program from a computer readable storage media to automatically maintain a specified water pressure within the system 100. More specifically, the automated management system 122 can increase (or decrease) water pressure within the system 100 using the processor to generate signals that increase (or decrease) the revolutions per minute of the oared pump 150 in response to water pressure data collected from pressure sensors within the system 100 (e.g., in the sloped canal 110) and the instructions stored in the computer readable storage media.

In some embodiments, the cylindrical body 104 of oared pump 150 can revolve, rotate or spin and may thereby cause the plurality of radial oars 105 to likewise revolve. Moreover, the plurality of radial oars 105 may cause a portion of the water contained in the covered pool 101 to flow into the sloped crank pipe 109. In certain embodiments, the semi-round router may direct or otherwise facilitate the flow of water from the covered pool 101 and into the sloped crank pipe 109. In some embodiments, the oared pump 150 can be configured to cause the portion of water that flows from the covered pool 101 to flow into the sloped crank pipe 109 at a substantially high rate of flow and/or at substantial pressure.

In some embodiments, water can flow from the sloped crank pipe 109 and into the sloped canal 110 and may ultimately flow into the reservoir 112. Moreover, in some embodiments, gravity may cause the water in the reservoir 112 to flow through turbine pipe 113 and operate hydro turbine system 115, which can be connected with hydro generator system 116. Alternatively or in addition, a water pressure in the reservoir 112 may cause water to flow from the reservoir 112 through the turbine pipe 113 and ultimately through the hydro turbine system 115. Thus, in some embodiments, the water flowing through turbine pipe 113 can also flow through turbine system 115 and thereby cause the hydro generator system 116 to operate and produce electrical power in response to the rotation of turbine system 115 caused by the flow of water through turbine system. Moreover, in some embodiments the shaft 102 is coupled to a reducer gear that is in turn coupled to an electromotor. In certain embodiments, the electromotor can be in electrical communication with the hydro generator system 116 (e.g., wires connecting the electromotor and the hydro generator system 116 such that power can flow between each), such that power generated by hydro generator system 116 can also be used to (at least partially) power oared pump 150.

Figure 2:
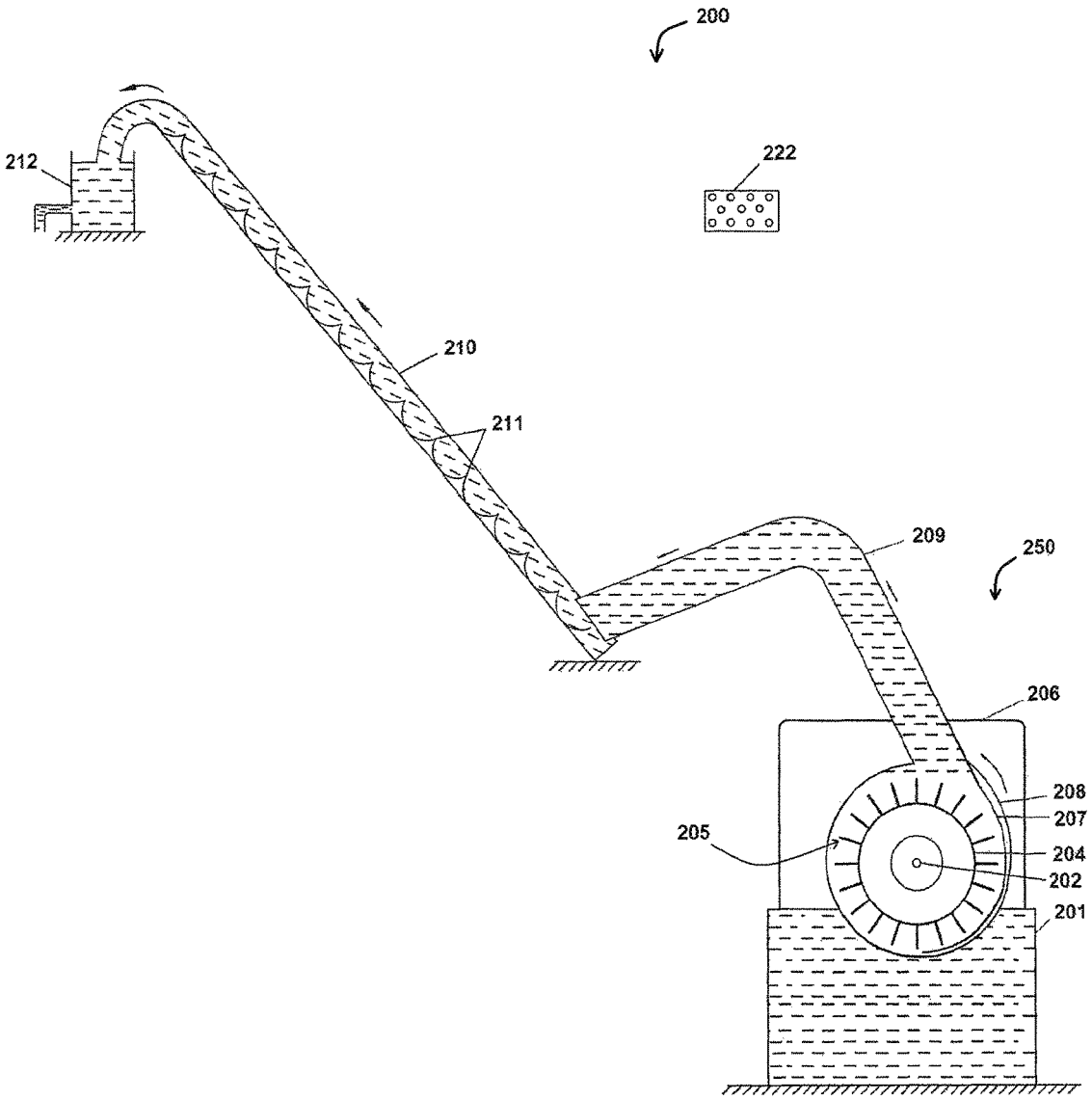
FIG. 2 illustrates a water pumping set in accordance with some embodiments.

FIG. 2 illustrates a water pumping set 200 in accordance with some embodiments. Water pumping set 200 can correspond to the appropriate portion of hydroelectric station 100 described above (e.g., oared pump 150, pipes/canals 109 and 110, and reservoir 112). The water pumping set 200 can include an oared pump 250 to pump water from a covered pool 201 up a sloped crank pipe 209 and a sloped canal 210 to ultimately collect in a reservoir 212. In some embodiments, the reservoir 212 is in fluid communication with the covered pool 201 via the sloped crank pipe 209 and the sloped canal 210.

Some embodiments of the oared pump 250 can include a plurality of radial oars 205 rigidly coupled to a cylindrical body 204 that is configured to rotate when the oared pump 250 operates. The cylindrical body 205 can be coupled to a shaft 202 that is in turn coupled to an electromotor or other means of rotating the cylindrical body 204 by rotating the shaft 202. In some embodiments, a router 207 can be fixedly coupled to a pump cover 206. In certain embodiments, the pump cover 206 can be configured to prevent water loss and retain water within the pumping set 200. Moreover, the router 207 can be configured with a round, semi-round, or curved shape in a similar manner to the description of the router 107 provided with reference to FIG. 1 above. Similarly, some embodiments of the router 207 may be fixedly coupled with at least one side panel 208. In some embodiments, the upper end of the router 207 is fixedly coupled with sloped crank pipe 209; the sloped crank pipe 209 having a square cross section in some embodiments. In certain embodiments, the router 207 can be configured to direct water into the sloped crank pipe 209 when the oared pump 250 operates (i.e., when the cylindrical body 204, and thus the plurality of radial oars 205, revolves in a counter-clockwise direction).

In some embodiments, the water pumping set 200 includes an automated management system 222 that can control the operation of the water pumping set 200, including the operation of the oared pump 250. In some embodiments, the automated management system 222 can be configured to control one or more aspects of the operation of the water pumping set 200, including any suitable mechanical and electrical aspects of its operation.

In some embodiments, the automated management system 222 can be configured to control the water pressure in the whole system 200, for example by controlling the amount of water pumped by the oared water pump 250. More specifically, in some embodiments the automated management system 222 can be configured to send at least one control signal to an electromotor of the oared pump 250 (e.g., electromotor 320 described with reference to FIG. 3A) to set the rotations per minute at which the electromotor will rotate the cylindrical body 204 of the oared pump 250.

In some embodiments the automated management system 222 may be configured to monitor the water pressure and/or water flow within the system 200 (e.g., via one or more sensors disposed in sloped crank pipe 209) and to automatically maintain a specific water pressure or rate of flow within the system 200. More specifically, the automated management system 200 may detect that the water pressure within the system 200 has fallen below a specified threshold pressure value and may automatically increase the rotations per minute of the water pump 250 (e.g., by sending one or more control signals directly to the electromotor or via an inverter of the oared pump 250) to increase the amount of water pressure within the system 200. Alternatively, or in addition, the automated management system 222 can be configured to automatically decrease the water pressure within the system 200 by decreasing the rotations per minute of the oared water pump 250 via one or more electronic control signals sent to the at least one electromotor of the oared pump 250 (e.g., the electromotor 320 described with reference to FIG. 3A).

Figure 3A:
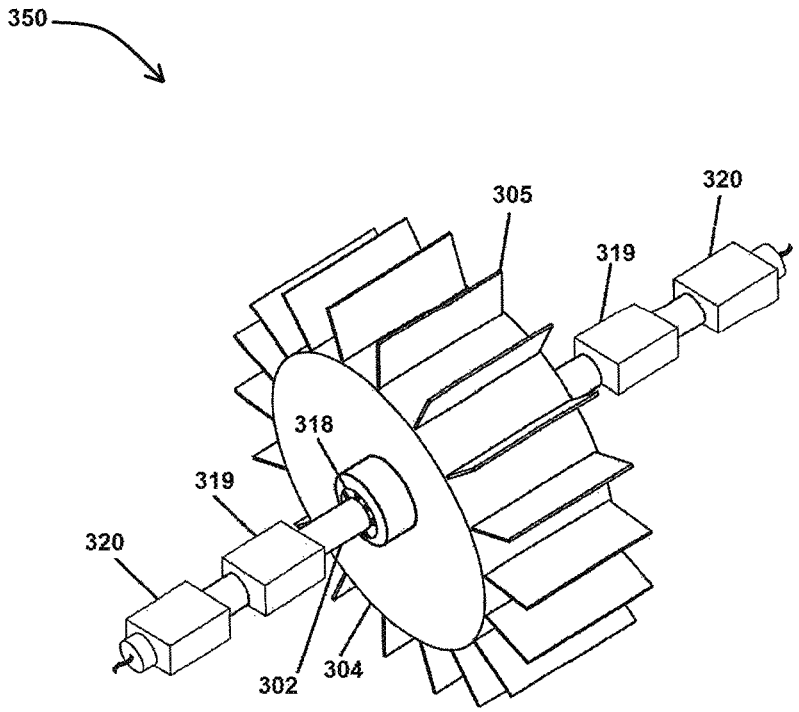
FIG. 3A illustrates a perspective view of an oared pump of a hydroelectric station in accordance with some embodiments.
Figure 3B:
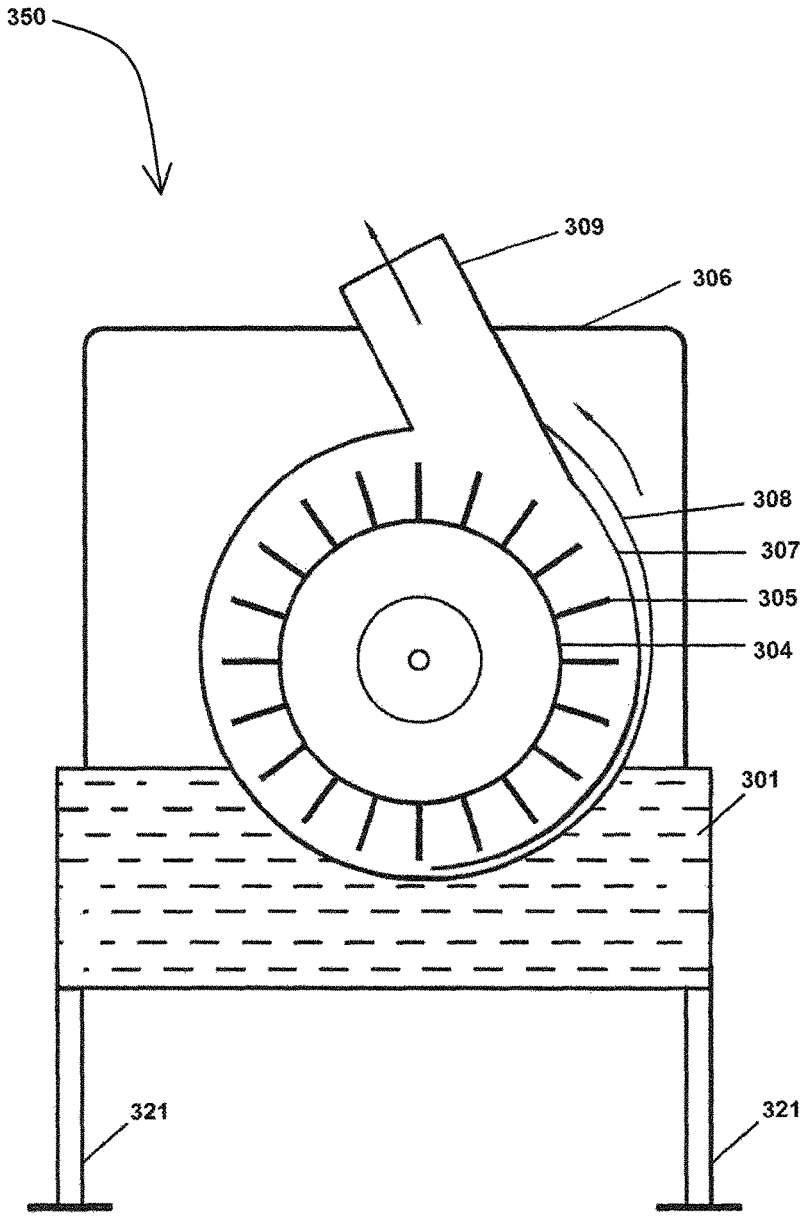
FIG. 3B illustrates a side view of an oared pump in accordance with some embodiments.
Figure 3C:
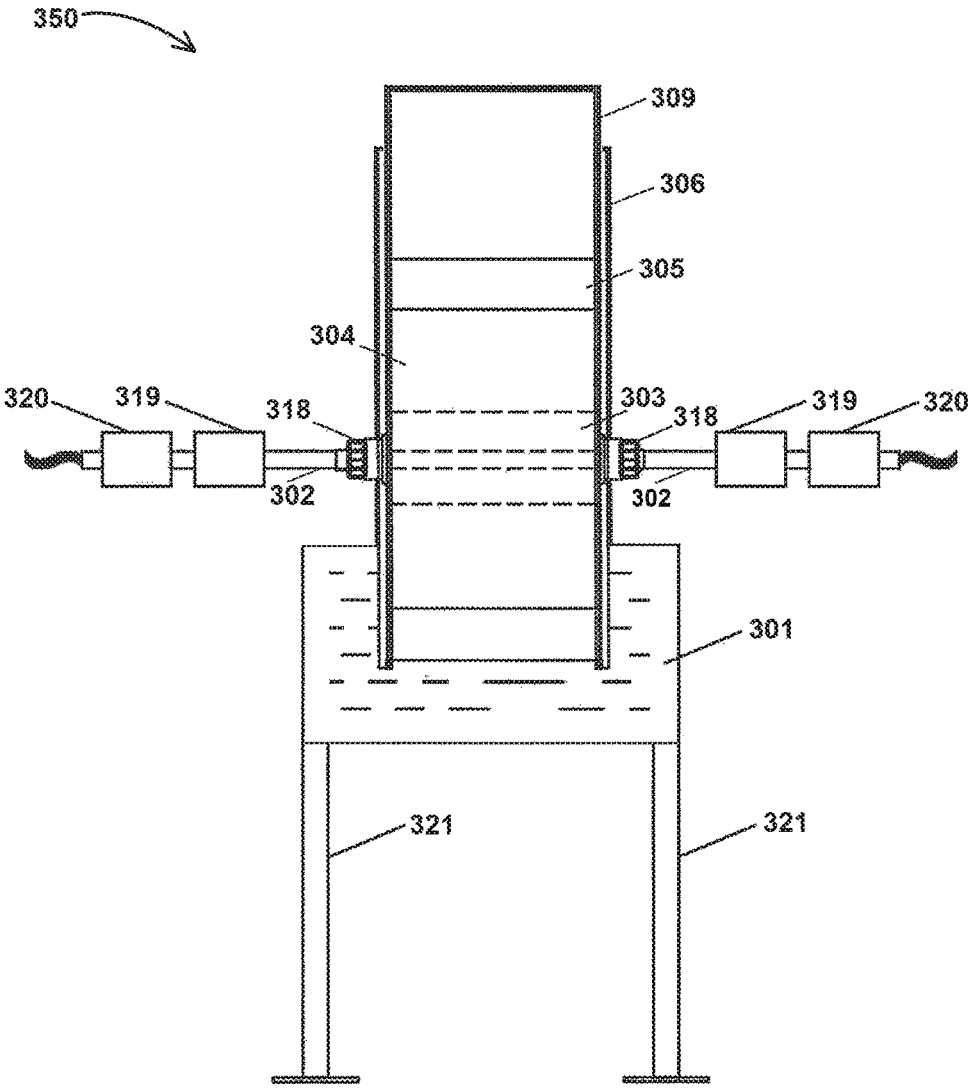
FIG. 3C illustrates a front view of an oared pump in accordance with some embodiments.

With reference to FIGS. 3A-3C collectively, an oared pump 350 is illustrated in three different perspectives, according to one embodiment. Oared pump 350 can correspond to oared pump 150 and/or 250. FIG. 3A illustrates a perspective view of an oared pump 350 of a hydroelectric station in accordance with some embodiments. FIG. 3B illustrates a side view of the oared pump 350 in accordance with the embodiment of FIG. 3A. FIG. 3C illustrates a front view of the oared pump 350 in accordance with the embodiment of FIG. 3A.

The proposed oared pump includes automated revolving part of the pump, which is made of a cylindrical rotary 302 coupled to a shaft 302, and a cylindrical body 304 that is in turn coupled to the cylindrical rotary 303. Furthermore, some embodiments may include a plurality of radial oars 305 that are fixedly coupled with the cylindrical body 304 of the oared pump. In certain embodiments, each oar of the plurality of radial oars 305 can be disposed along the cylindrical body 304 with an equal distance between any two oars of the plurality of radial oars 305.

In some embodiments, the oared pump 350 is operated with each end of the shaft 302 coupled to an electromotor 302 and reducer gears 319 (e.g., oared pump optionally includes two electro motors 302 and two reducer gears 319). In some embodiments, the reducer gears 319 and the electromotor 320 are coupled to opposite ends of a single shaft 302. Alternatively, in other embodiments the reducer gears 319 and the electro motors 320 can be coupled to different shafts 302 that may be independently controlled, such as by a magnetic clutch disposed within the cylindrical body 304, with an electromotor 320 that is in electrical communication with the hydro generator system (e.g., the hydro generator system 116 described with reference to FIG. 1); for example, the magnetic clutch can be used to selectively engage or disengage one side of the shaft 302 without engaging or disengaging the opposite side of the shaft 302.

In some embodiments, an automated management system (e.g., the automatic management systems 122 and 222 described with reference to FIGS. 1 and 2) can automatically control the magnetic clutch (i.e., alternate which symmetric side or half of the shaft 302 is coupled to the cylindrical body 304) such as by engaging and/or disengaging the magnetic clutch on one side of the shaft 302. Thus, in some embodiments, in a first phase of operation, oared pump 350 can be rotated via an electromotor 320 on one side while the electro motor 320 on the other side is disengaged from cylindrical body 304 via a magnetic clutch; in a second phase of operation, the opposite electro motor 320 and magnetic clutch can be engaged while the other electro motor 320 can be disengaged via its magnetic clutch. Such operation can prolong the life of electro motors 320. In some embodiments, the oared pump 350 further includes bearings 318 that are configured to facilitate operation of the oared pump 350. More specifically, the bearings 318 may allow the shaft 302 to couple with the cylindrical body 304 via the rotary 303.

In some embodiments, the shaft 302 may be separated into two halves that can engage and rotate the cylindrical body 304 independent on the other half of the shaft 304, and may be symmetric about the cylindrical body 304 of the oared pump 350. Specifically, in some embodiments one half of the shaft 302, electromotor 320, bearings 318, and reducer gear 319 on one side of the cylindrical body 304 mirror the configuration of the same components on the other side of the cylindrical body 304, but each symmetric half of the shaft 302 can be selectively engaged (coupled) with the cylindrical body 304 via a magnetic clutch. In some embodiments, therefore, the symmetric configuration of the shaft 302 and the related components (e.g., bearings 318, reducer gear 319, and electromotor 320) can allow the system to selectively alternate which of the two symmetric halves of the shaft 302 is coupled to, and thus used to rotate, the cylindrical body 304.

In some embodiments, the magnetic clutch (not shown) can be in electrical communication with an automated management system (e.g., automated management system 122 or 222 described with reference to FIGS. 1 and 2). More specifically, an automated management system may automatically engage and/or disengage the magnetic clutch on each half of the shaft 302. Embodiments that use a magnetic clutch to selectively engage different halves of the shaft 302 may substantially reduce the amount of maintenance required to operate the oared pump 350.

The cylindrical body 304, the plurality of radial oars 305, and at least a portion of the shaft 302 can each be disposed within a pump cover 306 (shown in FIGS. 3B and 3C). Moreover, in some embodiments a portion of the cylindrical body 304 and a portion of the plurality of radial oars 305 can be disposed within water contained by the pump cover 306 in a covered pool 301 (shown in FIGS. 3B and 3C). More specifically, in some embodiments only some of the plurality of radial oars 305 are disposed in the water of the covered pool 301 at any time. In some embodiments, therefore, there is a first portion of the plurality of radial oars 305 that is disposed in the water of the covered pool 301 and a second portion of the plurality of radial oars 305 that is not substantially in contact with the water of the covered pool 301.

For example, in one embodiment a first portion of the plurality of radial oars 305 disposed in the water of the covered pool 301 may include 7 radial oars (e.g., 6 compartments formed by the 7 radial oars), and the second portion of the plurality of radial oars 305 may include 13 radial oars that are not substantially in contact with the water of the covered pool 301. In some embodiments, 6 (e.g., 5 compartments formed by the 6 radial oars), 5 (e.g., 4 compartments formed by the 5 radial oars), or 4 (e.g., 3 compartments formed by the 4 radial oars) radial oars may be disposed in the water of the covered pool 301 at any moment in time.

In some embodiments, when the cylindrical body 304 and the plurality of radial oars 305 rotate the portion of the plurality of radial oars 305 that is disposed in the water of the covered pool 301 causes a portion of the water to flow up the sloped crank pipe 309.

In some embodiments, a router 307 can be fixedly coupled to the pump cover 306. More specifically, the router 307 can facilitate the operation of the oared pump 350 by substantially directing the flow of water into the sloped crank pipe 309 during operation of the pump 350. Moreover, the router 307 can be configured so that during operation of the oared pump 350 the plurality of radial oars 305 can approach the router 307 (e.g., as each oar of the plurality 305 spins the portion of the oar that is opposite the cylindrical body 305 can approach the router 307) without actually coming into physical contact with the router 307.

In some embodiments, the router 307 is fixedly coupled with at least one side panel 308 which may further facilitate the flow of water into the sloped crank pipe 309 during operation of the oared pump 350. In some embodiments, the upper end of the router 307 is fixedly coupled with sloped crank pipe 309. In some embodiments, the router 307 can be configured to direct water into the sloped crank pipe 309 when the oared pump 350 operates. More specifically, the router 307 can be configured so that when the cylindrical body 304 revolves in a counterclockwise direction the water pumped by the plurality of radial oars 305 flows into the sloped crank pipe 309.

As described above with reference to FIGS. 1 and 2, some embodiments of the oared pump 350 can include a plurality of radial oars 305 configured with a specific number of radial oars 305. For example, in some embodiments the plurality of radial oars includes at least 10 (or 10) radial oars coupled to the cylindrical body 304 of the oared pump 350. In other embodiments, the plurality of radial oars 305 includes at least 15 (or 15) radial oars coupled to the cylindrical body 304 of the oared pump 350. In other embodiments, the plurality of radial oars 305 includes at least 18 (or 18) radial oars coupled to the cylindrical body 304 of the oared pump 350.

Moreover and as also described with reference to the embodiments of FIGS. 1 and 2, each of the radial oars of the plurality 305 can also be disposed at a specific angle relative to each adjacent oar. For example, any two adjacent oars of the plurality of radial oars 305 can substantially form a radial angle that is approximately twenty degrees. In other embodiments, any two adjacent oars of the plurality of radial oars 305 can substantially form a radial angle of approximately thirty degrees. As can be appreciated, the angle created by any two adjacent radial oars of the plurality of radial oars 305 can be determined by the number of radial oars in the plurality 305 and can be configured to substantially form any angle suitable for the operation of the oared pump 350.

In some embodiments, the oared pump 350 can be supported by a plurality of supports or base columns 321. As can be appreciated, the plurality of supports 321 can be configured to rigidly couple to each of the components of the oared pump 350 in a manner than stabilizes and supports the pump 350, such as during its operation. In certain embodiments, the number and placement of the plurality of supports 321 can be determined based on the configuration of the oared pump 350 (e.g., size, RPM of the electromotor, number of oars in the plurality of radial oars 305, and the like). Moreover, in some embodiments one or more of the base columns of the plurality of base columns 321 can be configured to physically couple with, or support, a body or housing that in turn couples with, or supports, the oared pump 350. Alternatively or in addition, the supports 321 may include a body of the oared pump, or the pump cover 306, such that one or more components of the pump 350 (e.g., the sloped crank pipe 309) are formed by the support 321 while the supports 321 also facilitate overall operation of the oared pump 350 (e.g., reducing or substantially preventing unwanted shaking of the oared pump 350 during its operation).

Some examples of the disclosure are directed to an oared water pump comprising: a pump cover configured to form a covered pool with a first volume of water; a cylindrical body disposed substantially within the pump cover; and a plurality of radial oars fixedly coupled to the cylindrical body, wherein a first portion of the plurality of radial oars is configured to be disposed in the first volume of water and a second portion of the plurality of radial oars is configured to be disposed outside of the first volume of water. Additionally or alternatively to one or more examples disclosed above, in some examples, the plurality of oars comprises between 5 and 30 radial oars and wherein the first portion of the plurality of radial oars that is configured to be disposed in the first volume of water comprises between 2 and 20 radial oars. Additionally or alternatively to one or more examples disclosed above, in some examples, the plurality of oars comprises between 12 and 24 radial oars and wherein the first portion of the plurality of radial oars that is configured to be disposed in the first volume of water comprises between 3 and 16 radial oars. Additionally or alternatively to one or more examples disclosed above, in some examples, the plurality of oars comprises between 15 and 20 radial oars and wherein the first portion of the plurality of radial oars that is configured to be disposed in the first volume of water comprises between 4 and 8 radial oars. Additionally or alternatively to one or more examples disclosed above, in some examples, the plurality of oars comprises 18 radial oars and wherein the first portion of the plurality of radial oars that is configured to be disposed in the first volume of water comprises between 4 radial oars.

Additionally or alternatively to one or more examples disclosed above, in some examples, an oared water pump comprises a pump cover configured to form a covered pool with a first volume of water; a cylindrical body disposed substantially within the pump cover; a plurality of radial oars fixedly coupled to the cylindrical body; and a first electromotor coupled to a first reducer gear, wherein the first reducer gear is also coupled to a first shaft that is configured to couple to the cylindrical body, the first electromotor configured to cause the cylindrical body and the plurality of radial oars to rotate via the first reducer gear to pump a portion of the first volume of water out of the covered pool. Additionally or alternatively to one or more examples disclosed above, in some examples, the reducer gear of the oared pump is configured with a reduction ratio of two to one. Additionally or alternatively to one or more examples disclosed above, in some examples, the reducer gear of the oared pump is configured with a reduction ratio of ten to one. Additionally or alternatively to one or more examples disclosed above, in some examples, the reducer gear of the oared pump is configured with a reduction ratio of one hundred to one. Additionally or alternatively to one or more examples disclosed above, in some examples, the system further comprises a second electromotor coupled to a second reducer gear, wherein the second reducer gear is also coupled to a second shaft that is configured to couple to the cylindrical body, the second electromotor configured to cause the cylindrical body and the plurality of radial oars to rotate via the second reducer gear to pump a portion of the first volume of water out of the covered pool, and one or more magnetic clutches configured to selectively control the coupling of either of the first electromotor or the second electromotor with the cylindrical body.

Additionally or alternatively to one or more examples disclosed above, in some examples, an oared water pump comprises a pump cover configured to form a covered pool with a first volume of water; a cylindrical body disposed substantially within the pump cover; and a plurality of radial oars fixedly coupled to the cylindrical body with a radial angle between adjacent radial oars of the plurality of radial oars. Additionally or alternatively to one or more examples disclosed above, in some examples, the radial angle between adjacent radial oars of the plurality of radial oars is between 10 and 40 degrees. Additionally or alternatively to one or more examples disclosed above, in some examples, the radial angle between adjacent radial oars of the plurality of radial oars is between 15 and 35 degrees. Additionally or alternatively to one or more examples disclosed above, in some examples, the radial angle between adjacent radial oars of the plurality of radial oars is between 20 and 30 degrees. Additionally or alternatively to one or more examples disclosed above, in some examples, the radial angle between adjacent radial oars of the plurality of radial oars is 25 degrees.

Additionally or alternatively to one or more examples disclosed above, in some examples, an oared water pump may comprise a pump cover configured to form a covered pool with a first volume of water; a cylindrical body disposed substantially within the pump cover; and a plurality of radial oars fixedly coupled to the cylindrical body, wherein a first portion of the plurality of radial oars is configured to be disposed in the first volume of water and a second portion of the plurality of radial oars is configured to be disposed outside of the first volume of water. Additionally or alternatively to one or more examples disclosed above, in some examples, the plurality of oars comprises between 5 and 30 radial oars and wherein the first portion of the plurality of radial oars that is configured to be disposed in the first volume of water comprises between 2 and 20 radial oars. Additionally or alternatively to one or more examples disclosed above, in some examples, the plurality of oars comprises between 12 and 24 radial oars and wherein the first portion of the plurality of radial oars that is configured to be disposed in the first volume of water comprises between 3 and 16 radial oars. Additionally or alternatively to one or more examples disclosed above, in some examples, the plurality of oars comprises between 15 and 20 radial oars and wherein the first portion of the plurality of radial oars that is configured to be disposed in the first volume of water comprises between 4 and 8 radial oars. Additionally or alternatively to one or more examples disclosed above, in some examples, the plurality of oars comprises 18 radial oars and wherein the first portion of the plurality of radial oars that is configured to be disposed in the first volume of water comprises between 4 radial oars.

Additionally or alternatively to one or more examples disclosed above, in some examples, the oared water pump further comprises a first electromotor coupled to a first reducer gear, wherein the first reducer gear is also coupled to a first shaft that is configured to couple to the cylindrical body, the first electromotor configured to cause the cylindrical body and the plurality of radial oars to rotate via the first reducer gear to pump a portion of the first volume of water out of the covered pool. Additionally or alternatively to one or more examples disclosed above, in some examples, the reducer gear of the oared pump is configured with a reduction ratio of two to one. Additionally or alternatively to one or more examples disclosed above, in some examples, the reducer gear of the oared pump is configured with a reduction ratio of ten to one. Additionally or alternatively to one or more examples disclosed above, in some examples, the reducer gear of the oared pump is configured with a reduction ratio of one hundred to one. Additionally or alternatively to one or more examples disclosed above, in some examples, the oared water pump further comprises a second electromotor coupled to a second reducer gear, wherein the second reducer gear is also coupled to a second shaft that is configured to couple to the cylindrical body, the second electromotor configured to cause the cylindrical body and the plurality of radial oars to rotate via the second reducer gear to pump a portion of the first volume of water out of the covered pool, and one or more magnetic clutches configured to selectively control the coupling of either of the first electromotor or the second electromotor with the cylindrical body.

Additionally or alternatively to one or more examples disclosed above, in some examples, the plurality of radial oars are further configured with a radial angle between adjacent radials oars of the plurality of radial oars. Additionally or alternatively to one or more examples disclosed above, in some examples, the radial angle between adjacent radial oars of the plurality of radial oars is between 10 and 40 degrees. Additionally or alternatively to one or more examples disclosed above, in some examples, the radial angle between adjacent radial oars of the plurality of radial oars is between 15 and 35 degrees. Additionally or alternatively to one or more examples disclosed above, in some examples, the radial angle between adjacent radial oars of the plurality of radial oars is between 20 and 30 degrees. Additionally or alternatively to one or more examples disclosed above, in some examples, the radial angle between adjacent radial oars of the plurality of radial oars is 25 degrees.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best use the invention and various described embodiments with various modifications as are suited to the particular use contemplated.

The invention claimed is:

1. An oared water pump system comprising:

a pump cover configured to form a covered pool with a first volume of water;

a cylindrical body disposed substantially within the pump cover;

at least one shaft coupled to a center of the cylindrical body at a first end of the at least one shaft, and coupled to an electromotor at a second end of the at least one shaft, and wherein the at least one shaft defines an axis of rotation around which the electromotor is configured to rotate the at least one shaft and the cylindrical body;

a plurality of radial oars fixedly coupled to the cylindrical body, wherein a first portion of the plurality of radial oars is configured to be disposed in the first volume of water and a second portion of the plurality of radial oars is configured to be disposed outside of the first volume of water;

a router that is fixedly coupled to the pump cover and shaped to facilitate the flow of water out of the covered pool and out of a top of the pump cover when the cylindrical body rotates, the router comprising a first portion disposed in the first volume of water and a second portion disposed outside of the first volume of water and wherein the router is configured to not come into physical contact with the plurality of radial oars;

an output port at the top of the pump cover and disposed proximate to the second portion of the router and configured to allow water to flow out of the top of the pump cover when the cylindrical body rotates; and an inclined pipe coupled to the output port at a first end of the inclined pipe and configured to receive water from the output port when the cylindrical body rotates.

2. The system of claim 1, wherein the plurality of radial oars comprises between 5 and 30 radial oars and wherein the first portion of the plurality of radial oars that is configured to be disposed in the first volume of water comprises between 2 and 20 radial oars.

3. The system of claim 2, wherein the plurality of oars comprises 18 radial oars and wherein the first portion of the plurality of radial oars that is configured to be disposed in the first volume of water comprises between 4 and 9 radial oars.

4. The system of claim 1 further comprising at least one reducer gear and at least one magnetic clutch coupled between one or more electromotors, including the electromotor, and the cylindrical body, the at least one reducer gear and the at least one magnetic clutch configured to selectively control a rotation of the cylindrical body in response to a rotation of the one or more electromotors, wherein the at least one electromotor is coupled to the at least one shaft by the at least one reducer gear and wherein the at least one reducer gear is further configured with a reduction ratio equal to a ratio of a number of rotations of the at least one electromotor corresponding to a single rotation of the cylindrical body.

5. The system of claim 4, wherein the reducer gear of the oared pump system is configured with a reduction ratio of two to one.

6. The system of claim 4, wherein the reducer gear of the oared pump system is configured with a reduction ratio of ten to one.

7. The system of claim 4, wherein the reducer gear of the oared pump system is configured with a reduction ratio of one hundred to one.

8. The system of claim 1, wherein the plurality of radial oars are further configured with a radial angle between adjacent radials oars of the plurality of radial oars, wherein the radial angle between adjacent radial oars of the plurality of radial oars is between 20 and 30 degrees.

9. The system of claim 1, wherein the inclined pipe is further configured with its first end coupled to the output port at a downward angle such that the inclined pipe communicates water in a downward direction from its first end to a second end of the inclined pipe that is opposite and below the first end of the inclined pipe.

10. The system of claim 9, further comprising an inclined channel in fluid communication with the inclined pipe, a first end of the inclined channel coupled to the second end of the inclined pipe, and wherein a second end of the inclined channel is higher than the first end of the inclined pipe.

11. The system of claim 10, wherein the inclined channel is configured with at least one waveform floor.

12. The system of claim 11, wherein the second end of the inclined channel is coupled to an upper reservoir that is disposed at a higher vertical position than the covered pool and wherein the inclined channel is further configured to communicate water from the covered pool to the upper reservoir.

13. The system of claim 12, further comprising a downpipe coupled to the upper reservoir and a hydroelectric system, the downpipe comprising a first portion configured to communicate water from the upper reservoir to the hydroelectric system and a second portion configured to communicate water from the hydroelectric system to a lower reservoir at a vertical position less than the vertical position of the upper reservoir, and wherein the hydroelectric system comprises at least one hydroelectric generator configured to generate electricity in response to the water communicated to and from the hydroelectric system by the downpipe.

14. The system of claim 13, wherein a portion of the pump cover substantially enclosing the cylindrical body and radial oars is fixedly coupled to a portion of the pump cover that forms the covered pool.

15. The system of claim 14, wherein the least one shaft coupled to the cylindrical body is substantially submerged in the first volume of water and wherein any portion of the cylindrical body with a vertical position lower than the at least one shaft is also substantially submerged in the first volume of water.

16. The system of claim 15, wherein the router is further configured to extend between and be fixedly coupled to opposite interior sides of the pump cover that are perpendicular to a surface of the router.

17. The system of claim 16, wherein a portion of the inclined pipe is fixedly coupled to the second portion of the router.

18. The system of claim 17, further comprising an automated control system configured to control operation of the oared pump system according to inputs stored in a computer readable storage medium.

19. The system of claim 18, further comprising a flow valve configured to enable water to flow from the lower reservoir to the covered pool if the flow valve is open and to substantially prevent water from flowing from the lower reservoir to the covered pool if the flow valve is closed.

* * * * *